US005714706A

United States Patent [19]

Nakada et al.

[11] Patent Number: 5,714,706

[45] Date of Patent: Feb. 3, 1998

[54] METHOD AND APPARATUS FOR CONTROLLING MUSICAL SOUNDS BY PLAYER'S FOOT MOVEMENTS

[75] Inventors: Akira Nakada, Shizuoka-ken; Hisanori Katou, Shizuok-ken, both of Japan

[73] Assignee: Yamaha Corporation, Hamamatsu, Japan

[21] Appl. No.: 681,246

[22] Filed: Jul. 22, 1996

[30] Foreign Application Priority Data

Aug. 31, 1995 [JP] Japan ..... 7-245125

[51] Int. Cl.[6] ..... G10H 3/14

[52] U.S. Cl. ..... 84/730; 84/743; 36/139

[58] Field of Search ..... 84/730, 743, 746; 36/136, 139

[56] References Cited

FOREIGN PATENT DOCUMENTS 54-19338 7/1979 Japan .
6010505 1/1985 Japan .
61-135396 8/1986 Japan .
63-45592 3/1988 Japan .
6202635 7/1994 Japan .

*Primary Examiner*—William M. Shoop, Jr.
*Assistant Examiner*—Jeffrey W. Donels
*Attorney, Agent, or Firm*—Loeb & Loeb LLP

[57] ABSTRACT

A musical sound controlling apparatus to be placed inside a shoe and operated by the foot of a user. The musical sound controlling apparatus has a substrate plate and at least a piezoelectric sensor device. The substrate plate and the piezoelectric sensor device include a pair of hook and loop pads for detachably connecting the piezoelectric sensor device and the substrate member. Upon depression of the piezoelectric sensor device by the foot of a user, the piezoelectric sensor generates a signal for controlling musical sounds. Furthermore, the substrate plate is divided into two separated sections, a toe section and a heel section. A size adjusting device slidably couples the heel section to the toe section so that the overall size of the musical sound controlling apparatus can be changed according to the size of the shoe.

18 Claims, 4 Drawing Sheets

METHOD AND APPARATUS FOR CONTROLLING MUSICAL SOUNDS BY PLAYER'S FOOT MOVEMENTS

BACKGROUND OF THE INVENTION

1. Field of the Invention

Embodiments of the present invention relate to a method for controlling musical sounds by movements of the body of a user. More particularly, embodiments of the present invention also relate to a body-movement type musical sound controlling apparatus for controlling musical sounds by operation of the hands, arms or foots of a user.

2. Description of Related Art

A variety of electronic musical instruments that are performed by using body movements of a performer (body-movement type electronic musical instruments) have been proposed. For example, Japanese laid-open patent application HEI 6-202635describes a body-movement type electronic musical instrument that controls musical sounds by movements of the hand and the arm of a performer. The electronic musical instrument includes a hand-grip controller that is operated by the hand of the performer for controlling the timing of generation of musical sounds, an elbow controller that is operated by the elbow of the performer for controlling the pitch of the musical sounds, and a shoulder controller that is controlled by the shoulder of the performer for controlling the loudness and the tone color of the musical sounds. Japanese Patent SHO 54-19338 describes a foot-operated type electronic musical instrument having keys and a sound source mounted on a shoe. More specifically, movements of the foot of the performer are detected by the keys to control the pitch and the timing of generation of musical sounds. In this foot-operated type electronic musical instrument, the performer wears a specially designed shoe for controlling the musical sounds. Musical sounds are controlled by operating the keys by movements of the foot of the performer. The shoe generally has key-type sensors mounted on an exterior surface of the shoe, and generation of musical sounds is controlled by contacting, tapping or hitting the key-type sensors to the floor.

However, as the key-type sensors of the foot-operated type electronic musical instrument are mounted on the exterior surface of the shoe, an external force that is received by the key-type sensors varies depending on various floor conditions. For example, even with the same tapping force, an external force applied to the key-type sensors varies depending on whether the floor is relatively hard or soft. As a result, the magnitude and the generation timing of a trigger signal for generating a musical sound will vary depending on the hardness of the floor. As a consequence, after rehearsing a piece of music on a hard floor in one place, the same foot movements do not generate the same musical sounds on a relatively soft floor in another place where the musical instrument is performed. On the other hand, if a piece of music is rehearsed on a relatively soft floor in one place, the same foot movements do not generate the same musical sounds on a relatively hard floor in another place where the musical instrument is performed. In other words, the piece of music is not reproduced with the same musical sounds as rehearsed. For example, where the loudness and the tone color are controlled by the operation of the foot, the same foot movement generates different loudness and tone colors. Similarly, where the timing of generating musical sounds is controlled, the same foot movement results in subtle shifts in the sound generation timing.

To compensate for the difference in the musical sounds, the performer is required to generate a greater (or smaller) foot movement or foot pressure. Generally, a musical instrument should generate the same sounds no matter where the musical instrument is played if the musical instrument is played with the same body movements. Therefore, it is a serious problem if the same musical sounds cannot be reproduced with the same performance in different places without changing the performance or the body movements of the performer.

In the foot-operated type musical instrument as described above, the sensors are mounted on the exterior surface of the shoe. As a result, the size or the shape of the shoe needs to be changed for different performers since foot size and shape varies from one performer to another, and thus a variety of shoes in different sizes and shapes are required for different performers. Accordingly, shoes having the external sensors are not suitable for mass production, and the cost of the shoes is generally high.

Furthermore, the person's leg can generally generate a force that is substantially greater than the force generated by the person's arm. Moreover, when a person dances or jumps with a pair of shoes on, a force that is several times greater than the weight of the person is applied to the pair of shoes. Therefore, a sensor that is externally mounted on the shoe in a typical conventional foot-operated type electronic musical instrument must withstand the substantially large weight and force, and thus the sensor must have a durable structure. This further increases the overall cost for the foot-operated type electronic musical instruments.

SUMMARY OF THE INVENTION

It is an object of the present invention to provide a method of controlling musical sounds in which the same body movements provide the same control over the musical sounds.

It is another object of the present invention to provide a method of controlling musical sounds and a musical sound control apparatus that is inexpensive and durable with which musical sounds are controlled by the operation of the foot without requiring specially made shoes in various sizes.

In accordance with an embodiment of the present invention, a method of controlling musical sounds includes placing a sensor device on an inner sole of a piece of footwear to be worn by a user. Upon depression of the sensor by the user's foot of the user, the sensor generates a signal for controlling musical sounds.

In accordance with an embodiment of the present invention, the sensor device is divided into a front section and a rear section, and includes a size-adjusting device that connects the front section and the rear section. The size-adjusting device changes the distance between the front section and the rear section of the sensor device so that the overall length of the sensor device is changed. In a preferred embodiment, the sensor device is formed in the shape of a typical shoe insole to be fitted in a shoe. As a result, one type of the sensor device can be used for shoes of many different sizes, and thus there is no need to prepare sensor-mounted shoes in a variety of sizes and shapes.

In accordance with an embodiment of the present invention, a musical sound controlling apparatus includes a substrate member to be placed inside a shoe, and at least a sensor device that is detachably attached to the substrate member so that the sensor device can be placed at any desired location in the shoe, for example, just below the big toe area of the shoe. Upon depression of the sensor device by the user's foot, the sensor generates a signal for controlling musical sounds. In a preferred embodiment, the sensor device includes a piezoelectric sensor for generating a signal upon depression of the piezoelectric sensor.

In accordance with another embodiment of the present invention, a musical sound controlling apparatus has a substrate plate, a displacement plate capable of elastic displacement and disposed opposite the substrate plate, and a piezoelectric sensor fixed to the displacement plate. A spacer is placed between the substrate plate and the displacement plate to space the displacement plate a specified distance from the substrate plate. By the application of a pressure force that acts to narrow the specified distance between the substrate plate and the displacement plate, the piezoelectric sensor generates a signal for controlling musical sounds in response to the pressure force. In a preferred embodiment, the spacer extends across a portion of the displacement plate and the substrate plate to allow the displacement plate to bend about the spacer. As a result, the piezoelectric sensor that is fixed to the displacement plate is effectively deformed to generate a signal for controlling musical sounds without substantial displacement of the piezoelectric sensor. As a consequence, a plastic deformation of the piezoelectric sensor is substantially eliminated and thus durability of the piezoelectric sensor is improved.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

FIG. 3(*b*) shows a cross-sectional view of a sensor section in accordance with an embodiment of the present invention.

FIG. 3(*c*) shows a plan view of the sensor section shown in FIG. 3(*b*) as viewed in the direction of arrows C.

FIG. 4(*c*) shows a side view of the musical sound controlling apparatus shown in FIG. 4(*b*) in the most contracted state.

DETAILED DESCRIPTION OF EMBODIMENTS

Figure 1:
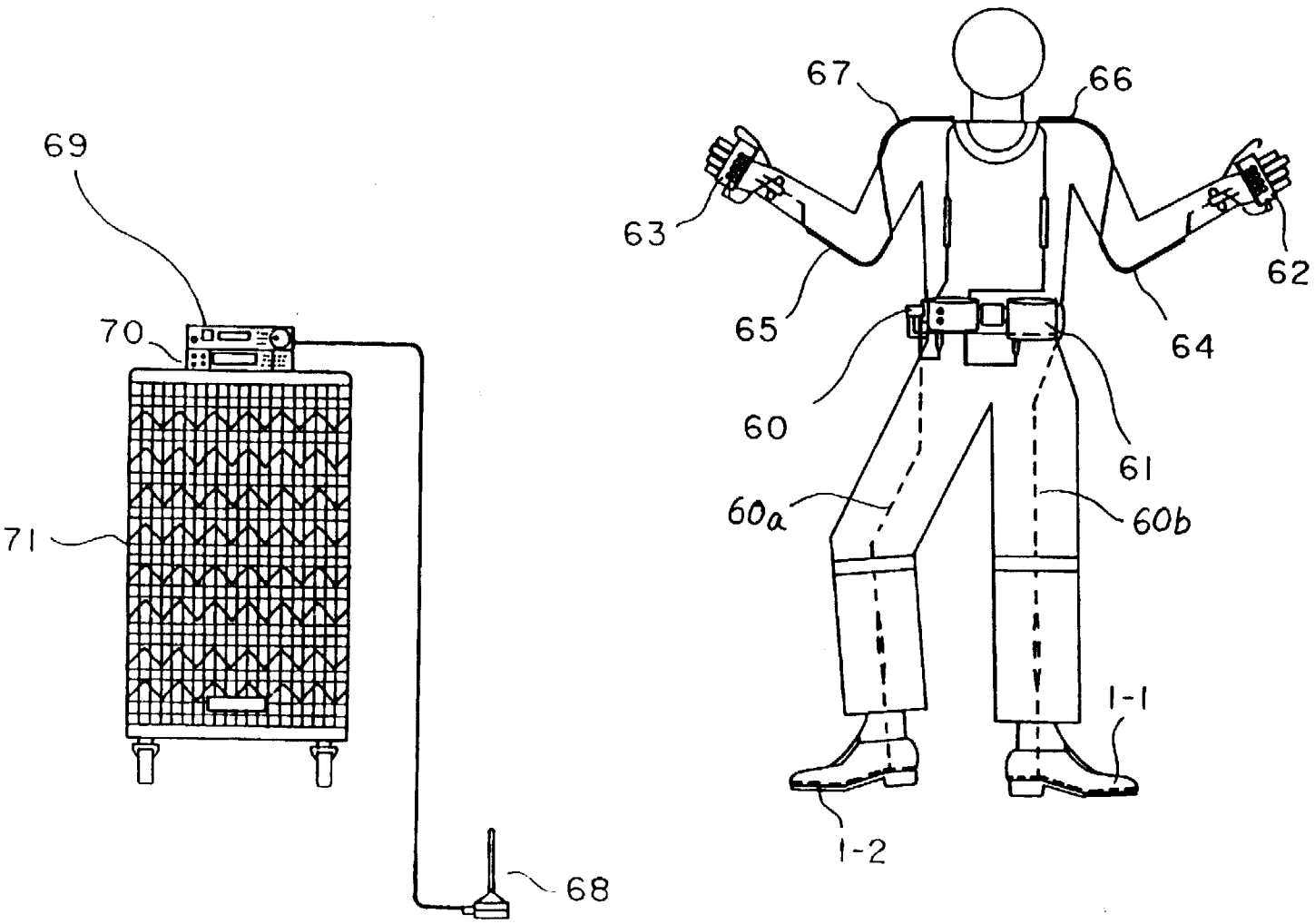
FIG. 1 schematically shows an overall front view of a body-movement type electronic musical instrument system including a musical sound control apparatus in accordance with an embodiment of the present invention.

FIG. 1 shows an overall view of a body-movement type electronic musical instrument system including a musical sound control apparatus in accordance with an embodiment of the present invention.

As shown in FIG. 1, a left foot sensor 1-1 for the left foot and a right foot sensor 1-2 for the right foot are mounted inside a left shoe and a right shoe, respectively. In this embodiment, the left foot sensor 1-1 and the right foot sensor 1-2 are used as rhythm section controllers that control the timing of generating sounds of, for example, a snare drum, a bass drum, hi-hat cymbals, and the like, that are assigned to the respective foot sensors. Alternatively, the left foot sensor 1-1 and the righ foot sensor 1-2 may be used for controlling sounds (for example, pitch, tone color and loudness) of automatic acompaniment performance and karaoke performance. A left grip controller 62 is attached to the left hand and a right grip controller 63 is attached to the right hand of a player. Each of the left grip controller 62 and the right grip controller 63 has a plurality of operation buttons. By the operation of the operation buttons, the left grip controller 62 and the right grip controller 63 control the timing of generating musical sounds and the transposition of the musical sounds. A left elbow controller 64 attached to the left elbow and a right elbow controller 65 attached to the right elbow control the pitch of musical sounds. The left and right elbows are stretched or bent so that combinations of stretching and bending of the left and right elbows change the pitch of musical sounds. A left shoulder controller 66 attached to the left shoulder and a right shoulder controller 67 attached to the right shoulder control the tone color and the loudness of musical sounds by bending and stretching the shoulders.

A foot sensor amplifier 60 amplifies sensor signals supplied from the left foot sensor 1-1 and the right foot sensor 1-2. In the illustrated embodiment shown in FIG. 1, the left foot sensor 1-1 and the right foot sensor 1-2 are connected to the foot sensor amplifier 60 by wires 60*a* and 60*b*, respectively. In an alternative embodiment, each of the left foot sensor 1-1 and the right foot sensor 1-2 may have a transmitter device (not shown) for transmitting sensor signals to an appropriate receiver device, for example, mounted in the foot sensor amplifier 60.

A wireless transmission unit 61 converts a signal from each of the above-described controllers into a signal that is acceptable by a musical instrument digital interface (MIDI) and radio-transmits the signal.

A reception unit 68 receives the signal transmitted from the wireless transmission unit 61, demodulates the signal into a demodulated MIDI signal and sends the demodulated MIDI signal to an interface unit 69. The interface unit 69 sends the demodulated MIDI signal to a sound source 70. The sound source 70 generates musical sounds representative of the received MIDI signal and releases musical sounds representative of the MIDI signal through a loud speaker system 71.

A musical sound for each of the sequences to be allocated to each of the foot sensors 1-1 and 1-2 is pre-designated by the use of the foot sensor amplifier 60, and the grip controllers 62 and 63 are used to change the sequences.

The musical sound control apparatus and the musical sound control method in accordance with the present invention will be described mainly with reference to embodiments implemented in foot sensors.

Figure 2:
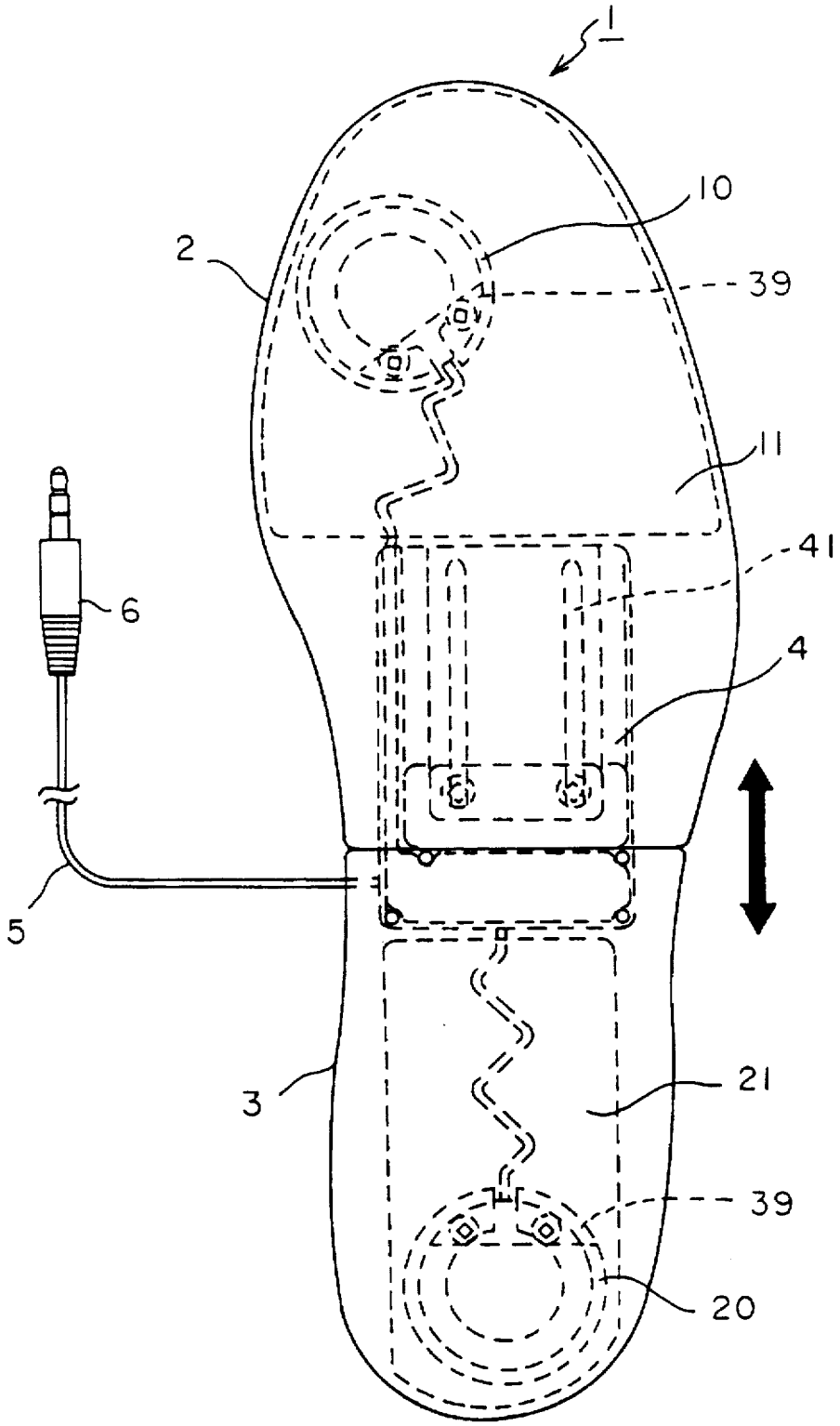
FIG. 2 shows a plan view of a musical sound control apparatus in accordance with an embodiment of the present invention.

FIG. 2 shows a plan view of a foot sensor 1 for the right foot. It is noted that a foot sensor for the left foot has a similar structure except that the foot sensor for the left foot is symmetrical with the foot sensor 1 for the right foot. Therefore, the description of the foot sensor for the left foot is omitted.

The foot sensor 1 has a peripheral shape that is similar to that of a typical shoe insole. As described later in detail, the foot sensor 1 is inserted in a shoe 50 (see FIG. 3) and operated by the foot of a user wearing the shoe 50. The insole-shaped foot sensor 1 is divided into two sections, a front section 2 and a rear section 3. The front section 2 and the rear section 3 are coupled together by a size adjusting section 4. The size adjusting section 4 is fixed to the rear section 3 and defines long slits 41. The front section 2 slidably engages the long slits 41 so that the front section 2 can be extended or contracted with respect to the rear section 3. As a result, the overall size of the foot sensor 1 can be changed.

As shown in FIG. 2, a first attaching section 11 is provided on the front section 2 to cover generally an area where the toes of the user are placed. A first sensor section 10 is removably attached to the first attaching section 11. The first attaching section 11 and the first sensor section 10 include removable engagement members, such as, for example, hook-and-loop pads, described later in detail. Alternatively, adhesive, snap fastening device, and the like may be used as the removable engagement members. As a result, the first sensor section 10 is removably attached to the first attaching section 11 at a desired location.

Further, a second attaching section 21 is provided on the rear section 3 to cover generally the entire length of the rear section 3. In the illustrated embodiment, the second attaching section 21 covers generally the entire surface of the rear section 3. A second sensor section 20 is detachably attached to the second attaching section 21. The second attaching section 21 and the second sensor section 20 also have the removable engagement members, such as hook-and-loop pads. As a result, the second sensor section 20 is also detachably attached to the second attaching section 21 at a specified location.

The above-described detachable engagement members are preferably formed from Velcro™ tapes including a tape of hooks and a tape of loops. In a preferred embodiment, a tape of hooks (or a tape of loops) is attached to each of the first attaching section 11 and the second attaching section 21 and a tape of loops (or a tape of hooks) is attached to each of the first sensor section 10 and the second sensor section 20, respectively.

Figure 3:
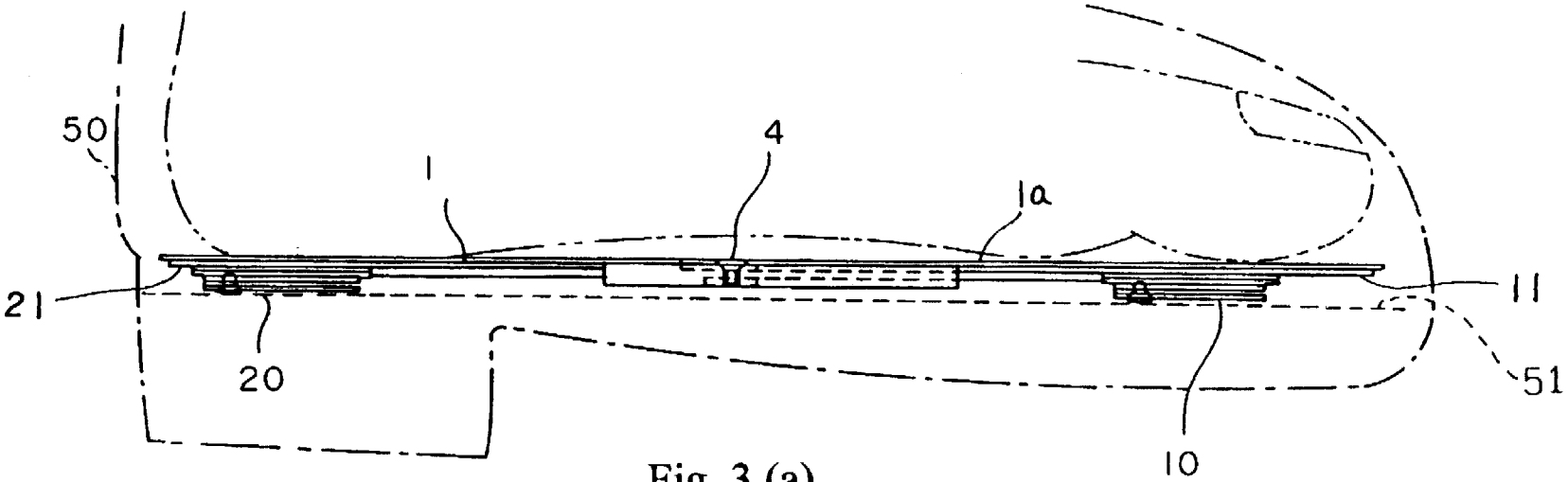
FIG. 3(*a*) shows a side view of a musical sound controlling apparatus in accordance with an embodiment of the present invention that is placed in a shoe.
Figure 3:
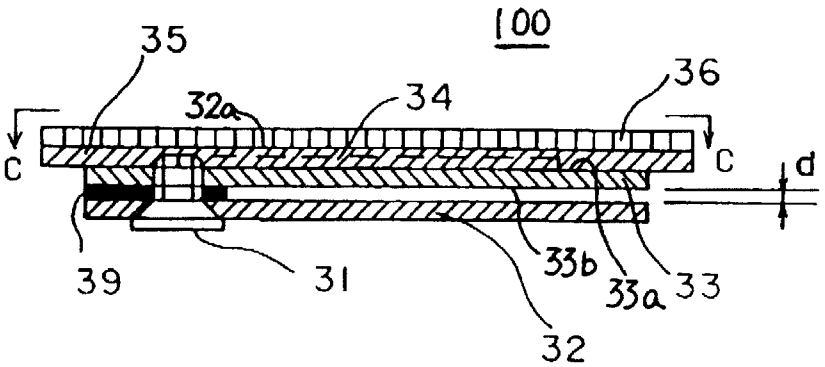
Figure 3:
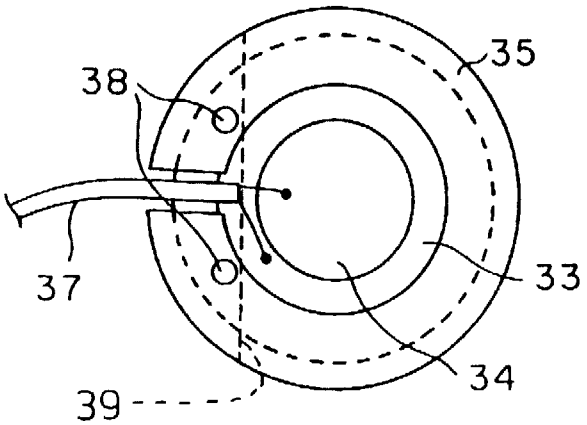

The size of the foot sensor 1 shown in FIG. 2 is adjusted by the size adjustment section 4 so that the foot sensor 1 may be inserted in the shoe 50, as shown in FIG. 3(*a*). As the user wears the shoe 50, the sole of the foot of the user is placed on a top surface 1*a* of the foot sensor 1. Namely, the foot sensor 1 is held between an inner sole top surface 51 of the shoe 50 and the sole of the performer's foot. As a result, the first sensor section 10 and the second sensor section 20 can be operated by the foot. Alternatively, a lining or a cover may be placed over the foot sensor 1 so that the foot of the user does not directly contact the foot sensor 1. In the illustrated embodiment shown in FIG. 2, the first sensor section 10 and the second sensor section 20 are placed at locations adjacent the big toe and the heel of the user, respectively. As a result, the first sensor section 10 can be depressed by the big toe, and the second sensor section 20 can be depressed by the heel.

As described later in detail, the first sensor section 10 and the second sensor section 20 have pressure sensors, such as, for example, piezoelectric sensors for generating electrical signals corresponding to pressure forces applied to the piezoelectric sensors as the piezoelectric sensors are depressed. The electrical signals are conducted from the first sensor section 10 and the second sensor section 20 to the size adjusting section 4 via respective lead wires 37 that are combined in a single lead wire 5 at the size adjusting section 4 and are outputted from a plug 6. The plug 6 is connected to the foot sensor amplifier 60 shown in FIG. 1. When the first sensor section 10 and the second sensor section 20 are depressed by the toe and the heel, respectively, electrical signals corresponding to the operation of the foot are generated, and musical sounds are controlled by the electrical signals.

FIG. 3(*a*) shows a cross-sectional view of the foot sensor placed inside the shoe 50. FIG. 3(*b*) shows a cross-sectional view of either the first sensor section 10 or the second sensor section 20 in detail, and FIG. 3(*c*) shows a plan view of either the first sensor section 10 or the second sensor section 20. In the illustrated embodiment, the first sensor section 10 and the second sensor section 20 have a substantially identical structure. However, in alternative embodiments, the first sensor section 10 and the second sensor section 20 may be formed in different shapes and different sizes.

As shown in FIG. 3(*a*), the foot sensor 1 is placed inside the shoe 50 so that the first sensor section 10 and the second sensor section 20 come in contact with the inner sole top surface 51 of the shoe 50. Before the foot sensor 1 is placed in the shoe 50, the separation between the front section 2 and the rear section 3 is changed by using the size adjusting section 4 so that the size of the foot sensor 1 fits the size of the shoe 50. In the illustrated embodiment, the first sensor section 10 is disposed below and adjacent the big toe of the foot, and the second sensor section 20 is disposed below and adjacent the heel of the foot. It is noted that the first sensor section 10 and the second sensor section 20 can be fixed at other locations in the first attaching section 11 and the second attaching section 21, respectively.

Each of the first sensor section 10 and the second sensor section 20 will be described in detail below. Since the two sensor sections 10 and 20 have the same structure, they will be generally referred to as a sensor section 100 where appropriate.

FIG. 3(*b*) shows a cross-sectional view of the sensor section 100, and FIG. 3(*c*) shows a plan view of the sensor section 100 as viewed in the direction of arrows C. In accordance with an embodiment as shown in FIGS. 3(*b*) and 3(*c*), the sensor section 100 is formed in the shape of a circular plate. In alternative embodiments, the sensor section 100 may be formed in a different shape, such as an oval, a square, a rectangle or the like. The sensor section 100 includes a substrate plate 32 that is placed on and comes in contact with the inner sole top surface 51 of the shoe 50. A displacement plate 33 is disposed opposite the substrate plate 32. The displacement plate 33 has an exterior surface 33*a* and an interior surface 33*b* that faces the substrate plate 32. The displacement plate 33 is spaced a specified distance from the substrate plate 32. A spacer 39 is placed between the substrate plate 32 and the displacement plate 33 to space the substrate plate 32 a specified distance from the displacement plate 33. The substrate plate 32, the displacement plate 33 and the spacer 39 are fixed to one another by two fixing screws 31. The spacer 39 extends only in a relatively small area of opposing surfaces of the substrate plate 32 and the displacement plate 33. As shown in FIG. 2, the spacer 39 in each of the first sensor section 10 and the second sensor section 20 is defined by a crescent section shown in broken lines.

A piezoelectric sensor 34 is fixed with adhesive or the like to the exterior surface 33*a* of the displacement plate 33. In the illustrated embodiment, the piezoelectric sensor 34 is formed in the shape of a circular plate. However, in alternative embodiments, the piezoelectric sensor 34 may be formed in a different shape, such as, for example, a square, a rectangle of the like.

A damper pad 35 is attached by adhesive to the exterior surface 33*a* of the displacement plate 33 on which the piezoelectric sensor 34 is disposed. The damper pad 35 is preferably made of relatively hard rubber, synthetic rubber, leather or the like, and generally formed in the shape of a ring extending along the peripheral area of the displacement plate 33. The damper pad 35 has a cut section through which a lead wire 37 extends out from the piezoelectric sensor 34. In a preferred embodiment, the damper pad 35 includes a plurality of radially extending grooves (not shown) for releasing air from inside the sensor section 100 when the sensor section 100 is depressed.

A removable engagement section 36 is fixed to a top surface 32*a* of the damper pad 35, as shown in FIG. 3(*b*). The removable engagement section 36 removably engages each of the first attaching section 11 and the second attaching section 21. As described above, in preferred embodiments, the removable engagement section 36 is preferably formed from Velcro™ tapes so that the sensor section 100 is removably attached to each of the first attaching section 11 and the second attaching section 21.

As shown in FIG. 3(*b*), a separation d is provided between the substrate plate 32 and the displacement plate 33. The separation d is set to a specified value which does not cause the displacement plate 33 to deform upon depression of the displacement plate 33. For example, the separation d is set to about 0.8 ram, when the substrate plate 32 and the displacement plate 33 are about 33 mm in diameter and 0.8 mm in thickness. However, the separation d may be set to different values depending on the material used for and the size of the displacement plate 33.

When the sensor section 100 is depressed by the foot, for example, by the big toe or the heel, since the spacer 39 extends only in an area adjacent the corner edges of the substrate plate 33 and the displacement plate 33, the displacement plate 32 moves with respect to the substrate plate 32 about the spacer 39 functioning as a hinge. In the illustrated embodiment, the displacement plate 33 is bent or curved about the spacer 39 upon application of a depression force to the displacement plate 33, and the separation d between the substrate plate 32 and the displacement plate 33 becomes smaller. As a result, the piezoelectric sensor 34, that is fixed to the displacement plate 33, also bends or warps, and thus generates piezoelectricity. The piezoelectricity is then outputted from the lead wire 37 as an electrical signal for controlling musical sounds.

The magnitude of the electrical signal varies in response to a pressure force applied to the sensor section 100. However, since the sensor section 100 is placed inside the shoe 50, the sensor section 100 generates substantially the same electrical signal in response to the same pressure applied by the foot. The sensor section 100 is normally in contact with the inner sole top surface 51 of the shoe 50 whose hardness is generally constant, and the hardness of the floor on which the user stands or dances does not have a substantial effect on the sensor section 100. Accordingly, the sensor section 100 generates substantially the same electrical signal in response to the same foot movement as rehearsed and that is intended by the user. As a result, the same foot movements as rehearsed result in the same musical performances as rehearsed without regard to the place where the performance occurs.

Figure 4:
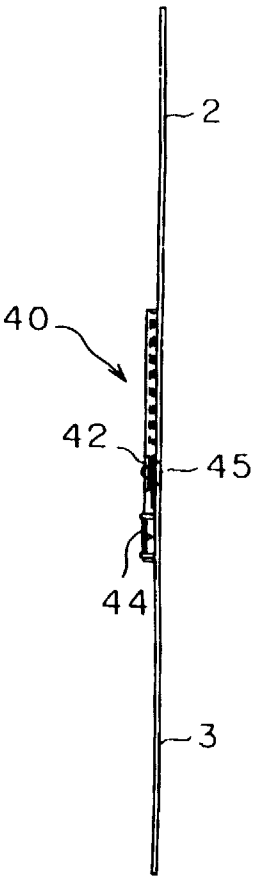
FIGS. 4(*a*) and 4(*b*) show bottom views of a musical sound controlling apparatus in accordance with an embodiment of the present invention in the most extended state and in the most contracted state, respectively.
Figure 4:
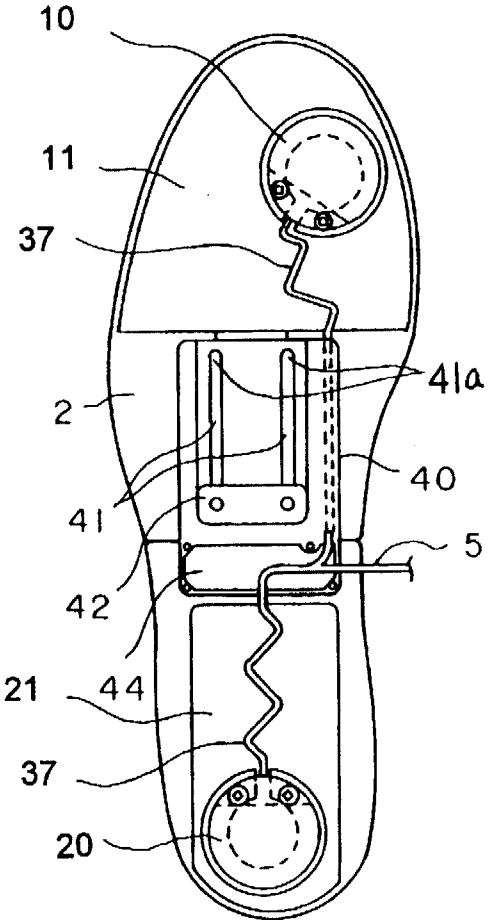
Figure 4:
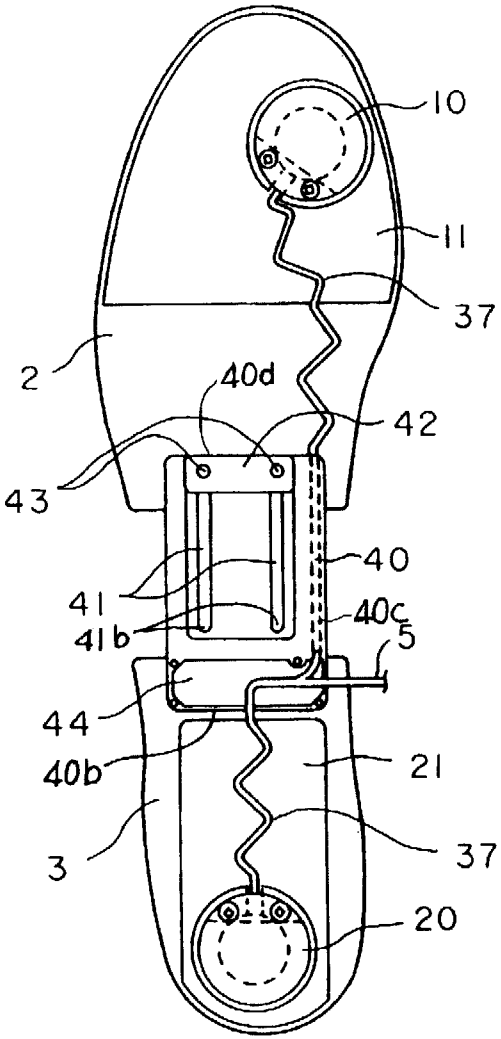

The size adjusting section 4, that adjusts the size of the foot sensor 1, will be described with reference to FIGS. 4(*a*), 4(*b*) and 4(*c*). FIG. 4(*a*) shows a bottom view of the foot sensor 1 in the most extended state, FIG. 4(*b*) shows a bottom view of the foot sensor 1 in the most contracted state, and. FIG. 4(*c*) shows a side view of the foot sensor 1.

As shown in FIGS. 4(*a*), 4(*b*) and 4(*c*), the size adjusting section 4 includes an adjusting section main body 40 having a portion fixed to the rear section 3 of the foot sensor 1, and a binding and holding plate 42 that is fixed to the front section of the foot sensor 1. The adjusting section main body 40 defines two relatively narrow, long apertures 41 extending in the lengthwise direction of the adjusting section main body 40. On the other hand, the binding and holding plate 42 defines screw holes 43. Two holding screws 45 (see FIG. 4(*c*)) engage the long apertures 41 and are screwed in the screw holes 43. As a result, a section 40*a* of the adjusting section main body 40 defining the long apertures 41 is sandwiched and held between the binding and holding plate 42 and the front section 42. The holding screws 45, that are screwed in the screw holes 43, are slidable in the long apertures 41. Accordingly, the front section 2 can be extended and contracted with respect to the rear section 3 along the long apertures 41. By this structure, the size of the foot sensor 1 is adjusted. FIG. 4(*a*) shows a state in which the foot sensor 1 is extended until the holding screws 45 contact the front ends 41*a* of the long apertures 41, and FIG. 4(*b*) shows a state in which the foot sensor 1 is contracted until the holding screws 45 contact the rear ends 41*b* of the long apertures 41. Accordingly, the foot sensor 1 can be adjusted within a size range between the largest size shown in FIG. 4(*a*) and the smallest size shown in FIG. 4(*b*).

The adjusting section main body 40 has a recessed section 44 formed adjacent a rear end section 40*b* of the adjusting section main body 40. The lead wire 37 from the first sensor section 10 and the lead wire 37 from the second sensor section 20 are passed through the recessed section 44 and combined into the single lead wire 5 that is then passed out from the recessed section 44. In an embodiment, a groove 40*c* for receiving the lead wire 37 is formed in the adjusting section main body 40 in the lengthwise direction extending from a front end section 40*d* to the recessed section 44. As shown in FIG. 4(*c*), the adjusting section main body 40 of the foot sensor 1 is very thin so that the operation of the first foot sensor 10 and the second foot sensor 20 is not affected by the adjusting section main body 40.

In the above-described embodiment, rhythm sections are controlled by the foot sensor 1. However, the present invention is not limited to this embodiment. For example, in alternative embodiments, the foot sensor 1 is used for controlling the tone color and loudness of musical sounds. In one embodiment, the loudness may be gradually changed in response to a specific number of taps with the foot.

In the above-described embodiment, a musical sound control method is applied to an apparatus that is mounted inside a shoe. However, the musical sound control method is applicable to other types of footware, such as sandals, boots and the like.

Furthermore, in the above-described embodiment, the piezoelectric sensor 100 is mounted on a musical sound controlling apparatus that is inserted in a shoe. However, in alternative embodiments, the piezoelectric sensor 100 is also used as a sensor section for, for example, electronic drums, drums for natural musical instruments, expression pedals, damper pedals, foot controllers, a floor stepping sound generating board and the like.

By the method and the apparatus for controlling musical sounds in accordance with embodiments of the present invention, signals for controlling musical sounds are generated without being affected by the hardness of the floor.

Accordingly, substantially the same signals are generated in response to the same body movements, and thus the same performance is performed by the same body movement no matter where the performance is performed.

Moreover, since the size of the foot sensor is adjustable, the foot sensor can be mounted in shoes in a variety of sizes and shapes. Furthermore, the foot sensor has an engaging member and at least one piezoelectric sensor that is removably attached to the engaging member. Accordingly, the piezoelectric sensor can be placed at an appropriate location within the engaging member where the piezoelectric sensor may be correctly and securely depressed by the foot of a player.

Still further, the piezoelectric sensor includes a substrate plate, a displacement plate disposed opposite the substrate plate and a piezoelectric element fixed to the displacement plate. A spacer is disposed between the substrate plate and the displacement plate to provided a predetermined distance between the substrate plate and the displacement plate. The spacer is located adjacent one corner of the substrate plate and the displacement plate so that the displacement plate is effectively bent or curved with respect to the substrate plate upon application of a pressure force to the displacement plate. As a result, the piezoelectric element is effectively bent or deformed to generate a signal, and thus plastic deformation of the piezoelectric element is substantially eliminated and therefore the durability of the piezoelectric sensor is improved.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method of controlling musical sounds, the method comprising the steps of:

placing a piezoelectric sensor device between a foot of a user and an inner sole top surface of a footwear;

applying a pressure force by the foot of the user to the piezoelectric sensor device to generate control signal for controlling musical sounds;

dividing the piezoelectric sensor device into a front sensor section and a rear sensor section;

slidably coupling the front sensor section and the rear sensor section;

spacing the front sensor section a specified distance from the rear sensor section; and changing the specified distance between the front sensor section and the rear sensor section.

2. A method of controlling musical sounds, the method comprising the steps of:

placing a piezoelectric sensor device between a foot of a user and an inner sole top surface of a footwear;

applying a pressure force by the foot of the user to the piezoelectric sensor device to generate control signal for controlling musical sounds;

mounting the piezoelectric sensor device on an insole-shaped member that fits inside the footwear;

inserting the insole-shaped member inside the footwear to place the piezoelectric sensor device on the inner sole top surface of the footwear;

dividing the piezoelectric sensor device into a front sensor section and a rear sensor section; and slidably coupling the front sensor section section and the rear sensor section.

3. A method of controlling musical sounds, the method comprising the steps of:

placing a piezoelectric sensor device between a foot of a user and an inner sole top surface of a footwear;

applying a pressure force by the foot of the user to the piezoelectric sensor device to generate control signal for controlling musical sounds;

mounting the piezoelectric sensor device on an insole-shaped member that fits inside the footwear;

inserting the insole-shaped member inside the footwear to place the piezoelectric sensor device on the inner sole top surface of the footwear;

dividing the piezoelectric sensor device into a front sensor section and a rear sensor section;

slidably coupling the front sensor section and the rear sensor section;

spacing the front sensor section a specified distance from the rear sensor section; and changing the specified distance between the front sensor section and the rear sensor section.

4. A musical sound controlling apparatus for use with a footwear, the footwear having an inner sole top surface, the musical sound controlling apparatus comprising:

an insole-shaped member having a bottom surface;

a first connecting member attached to the bottom surface of the insole-shaped member;

a pressure sensor device for generating a signal to control musical sounds in response to a pressure force applied to the pressure sensor device; and a second connecting member attached to the pressure sensor device, the second connecting member for connecting to the first connecting member of the insole-shaped member, wherein the insole-shaped member includes a front section, a rear section separated from the front section, and a third connecting member for connecting the front section with the rear section.

5. A musical sound controlling apparatus for use with a footwear, the footwear having an inner sole top surface, the musical sound controlling apparatus comprising:

an insole-shaped member having a bottom surface;

a first connecting member attached to the bottom surface of the insole-shaped member;

a pressure sensor device for generating a signal to, control musical sounds in response to a pressure force applied to the pressure sensor device; and a second connecting member attached to the pressure sensor device, the second connecting member for connecting to the first connecting member of the insole-shaped member, wherein the insole-shaped member includes a front section, a rear section separated from the front section, and size adjusting means for slidably connecting the front section and the rear section.

6. A musical sound controlling apparatus as defined in claim 5, wherein the pressure sensor device includes a first piezoelectric sensor to be attached to the front section and a second pressure sensor to be attached to the rear section.

7. A musical sound controlling apparatus for use with a footwear, the footwear having an inner sole top surface, the musical sound controlling apparatus comprising:

an insole-shaped member having a bottom surface;

a first connecting member attached to the bottom surface of the insole-shaped member;

a pressure sensor device for generating a signal to control musical sounds in response to a pressure force applied to the pressure sensor device; and a second connecting member attached to the pressure sensor device, the second connecting member for connecting to the first connecting member of the insole-shaped member, wherein the first connecting member includes a first half of a hook-and-loop pad and the second connecting member includes a second half of the hook-and-loop pad for detachably engaging the first half of the hook-and-loop pad.

8. A musical sound controlling apparatus for use with a footwear, the footwear having an inner sole top surface, the musical sound controlling apparatus comprising:

an insole-shaped member having a bottom surface;

a first connecting member attached to the bottom surface of the insole-shaped member;

a pressure sensor device for generating a signal to control musical sounds in response to a pressure force applied to the pressure sensor device; and a second connecting member attached to the pressure sensor device, the second connecting member for connecting to the first connecting member of the insole-shaped member, wherein the pressure sensor device includes:

a substrate plate;

a displacement plate disposed opposite the substrate plate, the displacement plate being capable of elastic displacement with respect to the substrate plate;

a spacer disposed between the substrate plate and the displacement plate for spacing the displacement plate a specified distance from the substrate plate; and a piezoelectric sensor element fixed to the displacement plate, the piezoelectric sensor element for generating a signal for controlling musical sounds in response to a pressure force applied to the piezoelectric sensor that acts to narrow the specified distance between the substrate plate and the displacement plate.

9. A musical sound controlling apparatus as defined in claim 8, wherein the spacer is disposed adjacent one side edge of the displacement plate to allow the displacement plate to bend about the spacer.

10. A musical sound controlling apparatus as defined in claim 9, wherein the displacement plate has a flexible protection member attached to a surface thereof opposite the substrate plate.

11. A musical sound controlling apparatus as defined in claim 8, wherein the bottom surface of the insole-shaped member generally comes in contact with the inner sole top surface of the footwear.

12. A musical sound controlling apparatus as defined in claim 8, wherein the pressure sensor device includes a piezoelectric sensor device.

13. A musical sound controlling apparatus comprising:

a substrate plate;

a displacement plate disposed opposite the substrate plate, the displacement plate being capable of elastic displacement with respect to the substrate plate;

a spacer disposed between the substrate plate and the displacement plate for spacing the displacement plate a specified distance from the substrate plate; and a piezoelectric sensor element fixed to the displacement plate, the piezoelectric sensor element for generating a signal for controlling musical sounds in response to a pressure force applied to the piezoelectric sensor that acts to narrow the specified distance between the substrate plate and the displacement plate, wherein a space between the substrate plate and the displacement plate is filled with nothing except for the spacer, and the piezoelectric sensor element is couples only to the displacement plate and not to the substrate plate.

14. A musical sound controlling apparatus as defined in claim 13, wherein the spacer is disposed adjacent one side edge of the displacement plate to allow the displacement plate to bend about the spacer.

15. A musical sound controlling apparatus for use with a shoe, the shoe having an inner sole top surface including a toe section and a heel section, the musical sound controlling apparatus comprising:

an insole-shaped member, the insole-shaped member including a front section generally covering the toe section of the inner sole top surface of the shoe, a rear section separated from the front section and generally covering the heal section of the shoe, and size adjusting means for slidably connecting the front section and the rear section;

a detachable first piezoelectric sensor device to be detachably attached to the bottom surface of the front section for generating a signal to control musical sound in response to a pressure force applied to the detachable first piezoelectric sensor; and a detachable second piezoelectric sensor device to be detachably attached to the bottom surface of the rear section for generating a signal to control musical sound in response to a pressure force applied to the detachable second piezoelectric sensor.

16. A musical sound controlling apparatus as defined in claim 15, wherein each of the front section and the rear section has a first half of a hook-and-loop pad fixed to the respective bottom surface, and each of the detachable first piezoelectric sensor and the detachable second piezoelectric sensor has a second half of the hook-and-loop pad for detachably engaging the first half of the hook-and-loop pad.

17. A musical sound controlling apparatus as defined in claim 16, wherein each of the detachable first piezoelectric sensor and the detachable second piezoelectric sensor includes:

a substrate plate;

a displacement plate disposed opposite the substrate plate, the displacement plate being capable of elastic displacement with respect to the substrate plate;

a spacer disposed between the substrate plate and the displacement plate for spacing the displacement plate a specified distance from the substrate plate; and a piezoelectric sensor element fixed to the displacement plate, the piezoelectric sensor element for generating a signal for controlling musical sounds in response to a pressure force applied to the piezoelectric sensor that acts to narrow the specified distance between the substrate plate and the displacement plate.

18. A musical sound controlling apparatus as defined in claim 15, wherein the insole-shaped member has a bottom surface that comes in contact with the inner sole top surface of the shoe.

* * * * *